United States Patent [19]

Davis

[11] Patent Number: 4,759,196

[45] Date of Patent: Jul. 26, 1988

[54] TWO-POSITION COVER FOR AIR HANDLING EQUIPMENT ENCLOSURE

[75] Inventor: James A. Davis, Franklin, Tenn.

[73] Assignee: American Standard Inc., New York, N.Y.

[21] Appl. No.: 54,467

[22] Filed: May 26, 1987

[51] Int. Cl.[4] ..... F24F 1/02

[52] U.S. Cl. ..... 62/326; 55/471; 62/DIG. 16; 98/34.6; 98/64

[58] Field of Search ..... 55/467, 471; 62/326, 62/427, DIG. 16; 98/33.1, 34.5, 34.6, 35, 39.1, 64, 94.2

[56] References Cited

U.S. PATENT DOCUMENTS

| | | | |
|---|---|---|---|
| 565,351 | 8/1896 | Hardy | 62/326 |
| 584,729 | 6/1897 | Monteverde | 62/326 |
| 833,648 | 10/1906 | Stimsun | 62/326 X |
| 2,250,352 | 7/1941 | Bolcom | 98/39.1 |
| 2,660,867 | 12/1953 | Borgerd | 62/427 |
| 3,960,527 | 6/1976 | Goettl | 98/34.6 X |
| 4,139,052 | 2/1979 | Lackey | 62/326 X |
| 4,281,522 | 8/1981 | Bussjager | 62/DIG. 16 X |

*Primary Examiner*—Harold Joyce

*Attorney, Agent, or Firm*—William J. Beres; David L. Polsley; Robert J. Harter

[57] ABSTRACT

An outdoor enclosure for air handling equipment is adaptable to accept add-on air handling equipment by virtue of a two-position cover panel. The cover panel has a generally rectangular shape and is attached to a side panel of the enclosure. The cover panel is selectively mountable in either a vertical position to cover a fresh air opening through the side panel or in an open position to uncover the opening. The cover is opened by pivoting it about its upper horizontal edge which is located just above the opening and swinging its lower edge outwardly away from the side panel. An add-on mist elimination filter is installed in a generally horizontal position betweeen the cover panel's lower edge and the lower edge of the side panel's opening. In the open position, the cover panel serves as a rain sheltering hood over the filter while the opening allows fresh outside air to be drawn into the suction side of a fan located inside the enclosure. The two-position cover panel facilitates the conversion of the enclosure while minimizing the need for special, single-purpose panels.

11 Claims, 6 Drawing Sheets

TWO-POSITION COVER FOR AIR HANDLING EQUIPMENT ENCLOSURE

TECHNICAL FIELD

The invention generally pertains to outdoor enclosures for air handling equipment such as a rooftop mounted air conditioner having a centrifugal fan, and more specifically pertains to an air handling enclosure having a two-position cover panel that enables the enclosure to be converted to accept add-on air handling equipment such as a demisting filter for fresh inlet air.

BACKGROUND OF THE INVENTION

Air handling equipment such as a centrifugal fan working in conjunction with a heat exchanger is often used to heat or cool the air within a building. When the equipment is mounted outside and on top of or alongside the building, an enclosure is typically used to shelter it from the outside environment.

In many installations, the fan draws all its inlet air from return air ducts within the building. It is often preferred, however, to have the fan not only draw return air from the building but to also draw in a portion of fresh air from outside the building. The outside air can contribute to the freshness of the air supplied to the building and, depending on the relative inside to outside air temperatures, can also improve the overall efficiency of providing the building's heating and cooling needs.

Currently, air handling enclosures without an open fresh air inlet connecting the fan inlet to outside air are modified by removing a panel that covers a fresh air opening through the enclosure. Uncovering the opening provides a fresh air inlet whose flow therethrough is controlled by installing add-on air handling devices such as hoods, mist elimination filters, and dampers. By not using the existing cover panel, however, additional single-purpose panels must be manufactured and supplied to adapt the enclosure to receive the add-on devices.

Manufacturing these additional single-purpose panels is an unnecessary expense. Therefore, it is an object of the invention to reduce the number of these panels by providing a dual-purpose, two-position cover panel for air handling enclosures.

Another object of the invention is to provide cost effective means of modifying an air handling enclosure to include an open fresh air inlet.

Another object is to provide a two-position cover panel that in one position covers a fresh air opening through the enclosure, and in another position uncovers the opening and engages an add-on air handling device.

Yet another object is to provide a two-position cover panel that when engaged to an add-on air handling device, the cover panel extends over the device to serve as its rain sheltering hood.

These and other objects will be apparent from the attached drawings and the description of the preferred embodiments that follow below.

SUMMARY OF THE INVENTION

The subject invention is an air handling enclosure having a cover panel that is selectively mountable to the enclosure in at least two positions. In one position, the cover panel engages an add-on air handling device and uncovers a fresh air opening through the enclosure. In another position, the cover panel covers the fresh air opening and is mounted to the enclosure, separate from the add-on device.

DESCRIPTION OF THE PREFERRED EMBODIMENT

Figure 1:
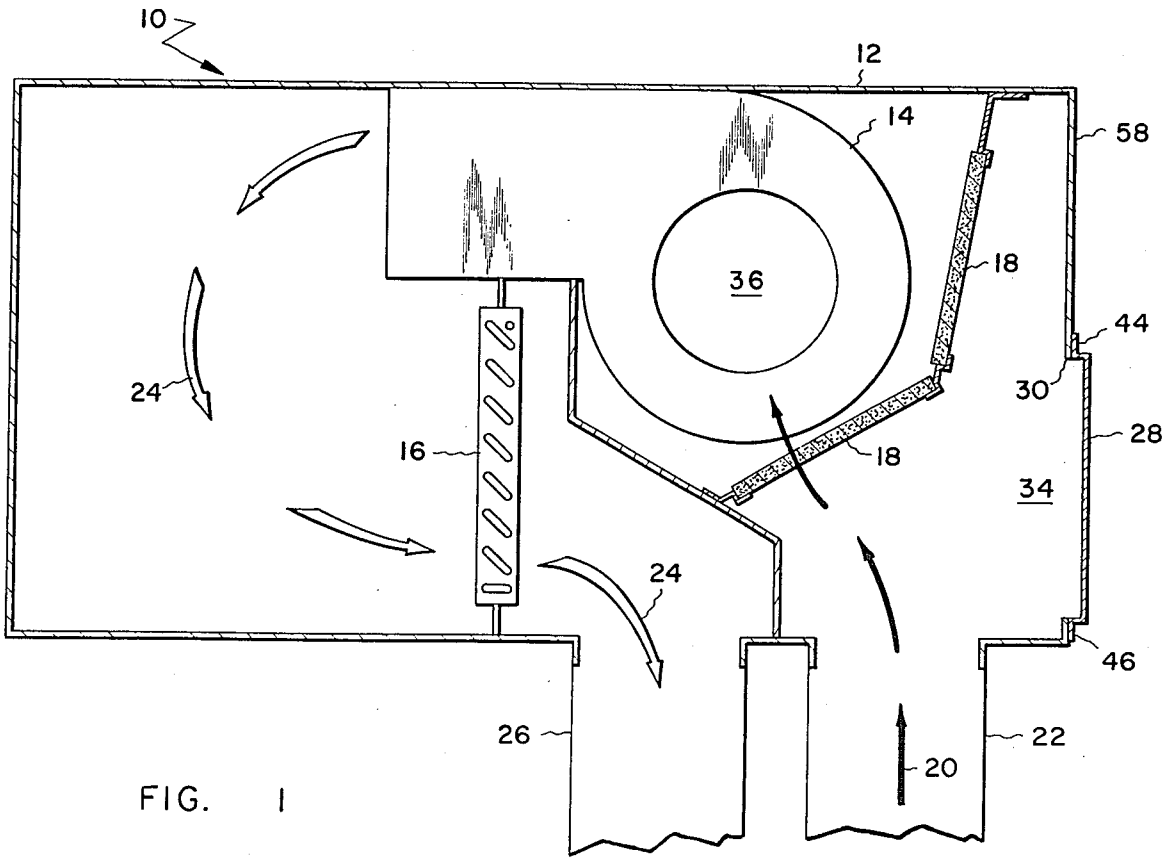
FIG. 1 is a schematic view of a basic air handling unit having a cover panel in a closed position.
Figure 2:
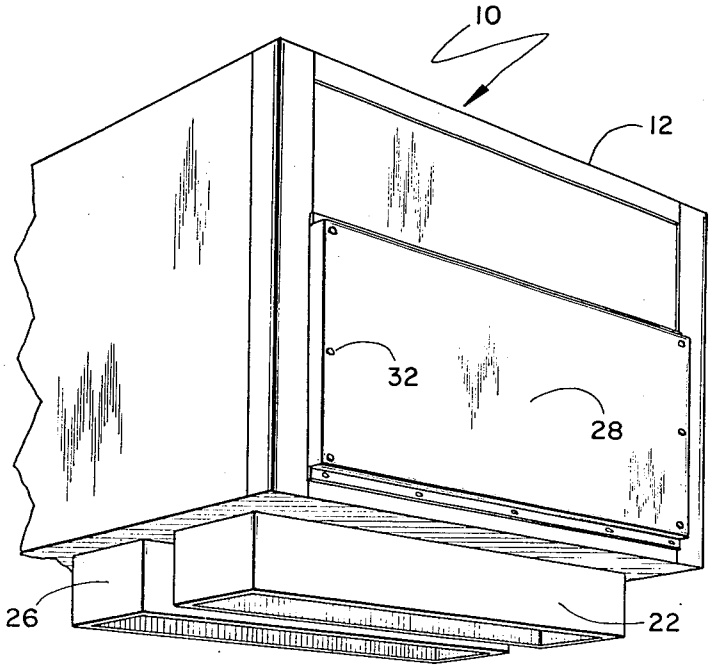
FIG. 2 is a perspective view of the basic air handling unit of FIG. 1.

A basic outdoor air handling unit 10, shown in FIGS. 1 and 2, supplies temperature conditioned air to a building it serves. Unit 10 is a rooftop mounted unit, however, similar units can also be mounted alongside the building. Unit 10 includes an enclosure 12 which contains a centrifugal fan 14, a heat exchanger 16, and a set of air filters 18. Heat exchanger 16 represents any heat exchanger that heats or cools air passing through it. Examples of heat exchanger 16 include refrigeration evaporator coils, condenser coils, steam coils, and heat exchangers which convey hot combustion products.

Fan 14 draws return air 20 into enclosure 12 from a return air duct 22 which runs through the interior of the building. By means of fan 14, return air 20 is drawn through filters 18 and is discharged as supply air 24 through heat exchanger 16 which conditions the air before it is conveyed back to the building through supply air duct 26.

Unit 10 also includes a two-position cover panel 28 which is shown in the closed position in FIGS. 1 and 2. Panel 28 is fastened to enclosure 12 by means of sheet metal screws 32 or other conventional fastener. In the closed position, panel 28 is positioned to cover an enclosure opening 30. When uncovered, opening 30 provides a fresh air inlet to fan 14 by means of a fresh air passage 34 located between fan inlet 36 and opening 30.

Figure 3:
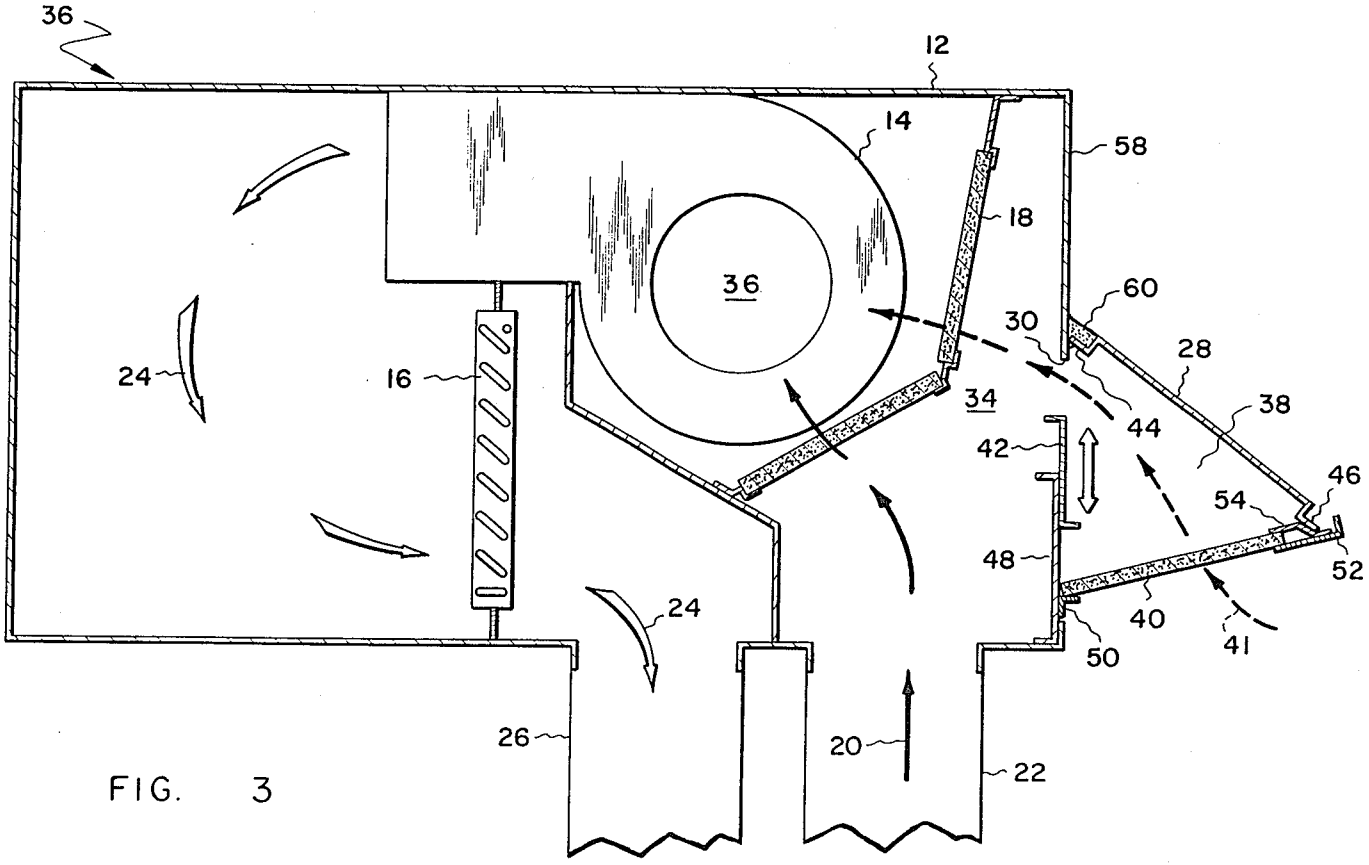
FIG. 3 is a schematic view of an air handling unit having a manually operated damper and having a cover panel in an open position engaging a demisting filter.

By repositioning cover panel 28 to an open position, as shown in FIG. 3, basic unit 10 is readily converted to accept add-on air handling devices which include any device that guides, regulates, or conditions air. Unit 36, of FIG. 3, is one example of a converted unit. The add-on devices of unit 36 include triangular support panels 38 and a demisting filter 40. Demisting filter 40 is often referred to in the industry as a permanent filter which is made up of several layers of corrugated metal screen that filters out moisture and/or dirt particles. Opening 30 and the add-on devices allow fan 14 to draw a portion of fresh outside air 41 through demisting filter 40 and into enclosure 12. Subsequently, fresh air 41 along with return air 20 pass through filters 18 before entering fan inlet 36. It should be appreciated, however, that many alternate functions can also be accomplished with various other add-on devices such as humidifiers, heat exchangers, non-permanent air filters, and air ducts.

Figure 4:
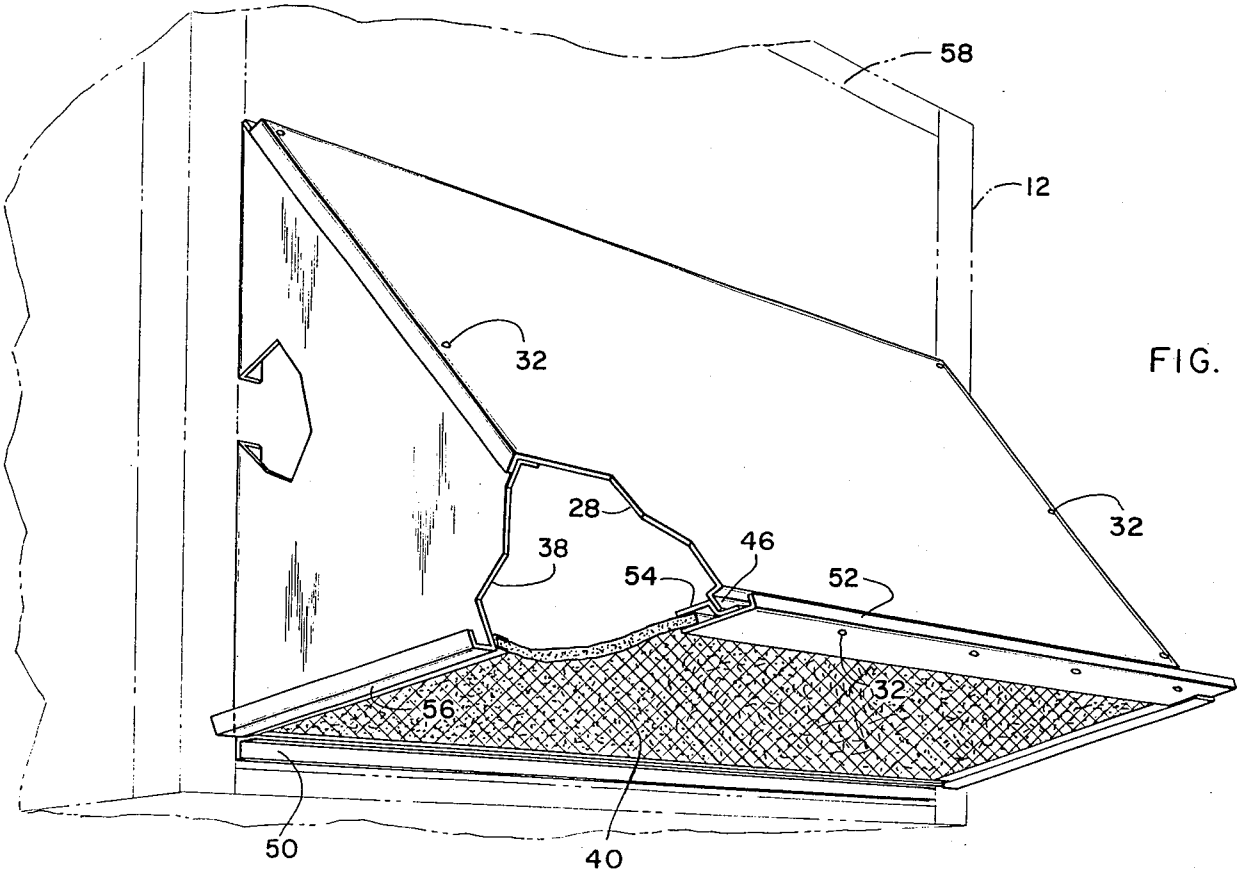
FIG. 4 is a cutaway perspective view of a cover panel in an open position.

Cover panel 28 is repositioned from the closed to the open position by pivoting the cover about its upper edge 44 while swinging its lower edge 46 outwardly away from enclosure 12. Repositioning panel 28 to the open position uncovers opening 30 which places fan inlet 36 in fluid communication with outside air 41 by way of fresh air passage 34. An insulated panel 48 and an adjustable flow regulating damper 42 is mounted to enclosure 12 to provide a variable restriction through opening 30. By manually sliding damper 42 up or down, the size of the restriction is varied to obtain a desired flow rate of fresh air 41 into enclosure 12. Cover panel 28 is held in the open position, as shown in FIG. 4, by fastening cover 28 to the triangular shaped support panels 38 by means of fasteners 32. Adaptor brackets 50, 52, 54, and 56 hold demisting filter 40 under cover panel 28 in a generally horizontal position between a side wall 58 of enclosure 12 and the lower edge 46 of cover panel 28.

In the open position, cover panel 28 serves as a rain sheltering hood over filter 40, and brackets 52 and 56 form rain gutters which drain water away from the edge of filter 40 to help prevent water from being drawn into the enclosure. To further guard against water entering the enclosure, a conventional sealant 60 is applied against the enclosure along the upper edge 44 of cover panel 28.

It should be appreciated, by those skilled in the art, that there is a myriad of mounting bracket geometries that would be acceptable substitutes for brackets 50, 52, 54, and 56. In addition, although cover panel 28 is repositioned by pivoting it about its upper edge, the cover panel can be repositioned in any number of ways to engage various other add-on air handling devices.

Figure 5:
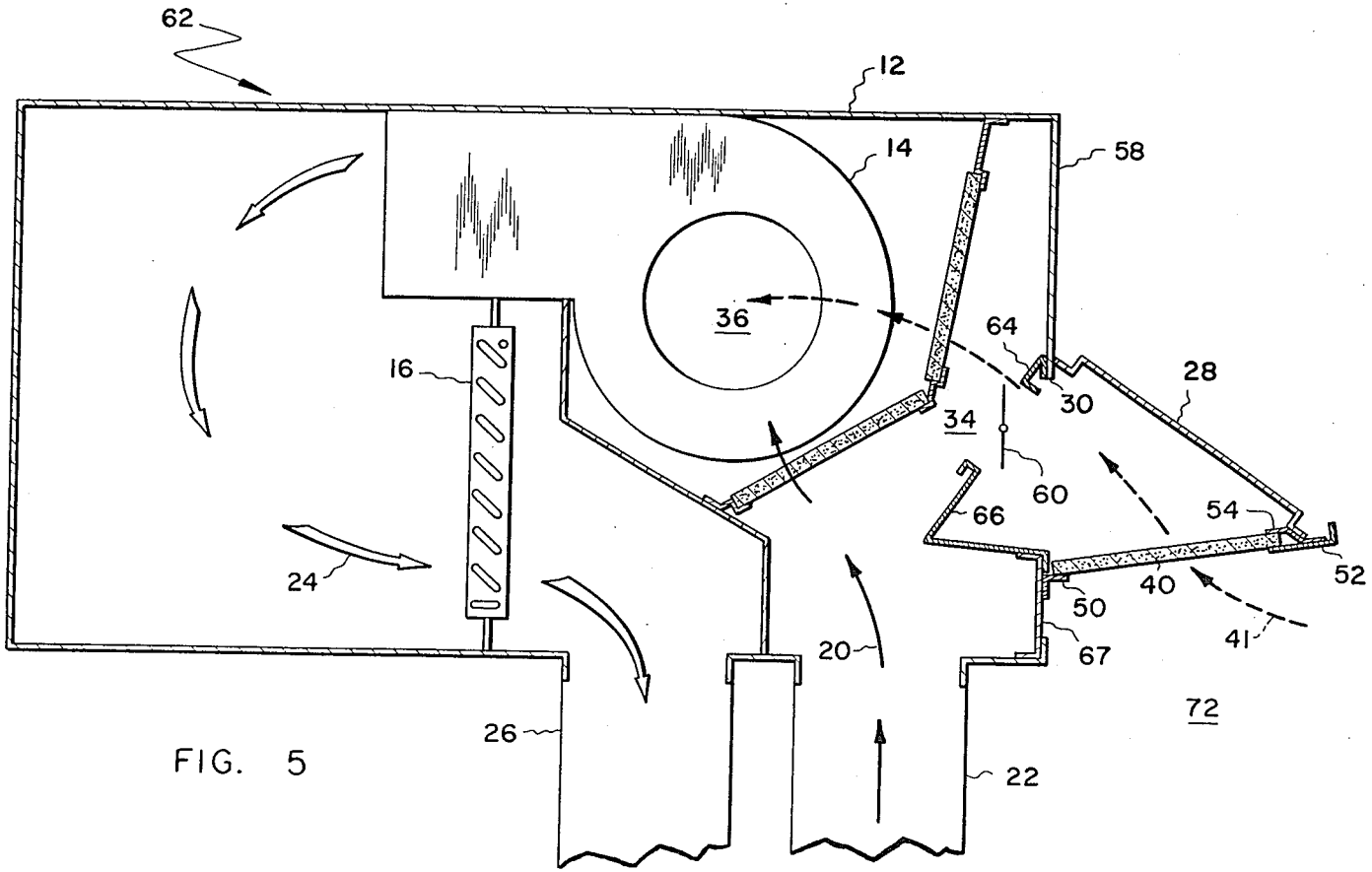
FIG. 5 is a schematic view of an air handling unit having a power actuated damper.

The basic unit of FIG. 1 can also be converted to unit 58 shown in FIG. 5. In place of the manually operated damper of unit 36, unit 62 includes damper 60 which can be electrically or pneumatically actuated. Damper 60 is disposed within fresh air passage 34 between opening 30 and fan inlet 36. An upper seal bracket 64 for damper 60 is mounted at the upper edge of fresh air opening 30. A baffle panel 66 and a lower panel 67 is included with unit 62 instead of the insulated panel 48 of unit 36.

Figure 6:
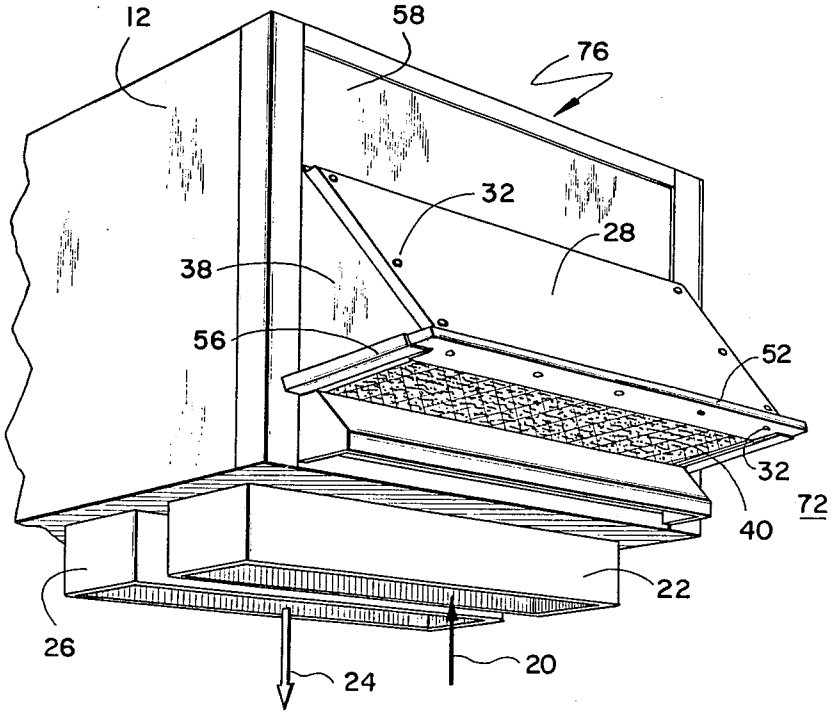
FIG. 6 is a perspective view of an air handling unit including two flow regulating dampers, a relief valve, and a demisting filter engaging a cover panel which is in the open position.
Figure 7:
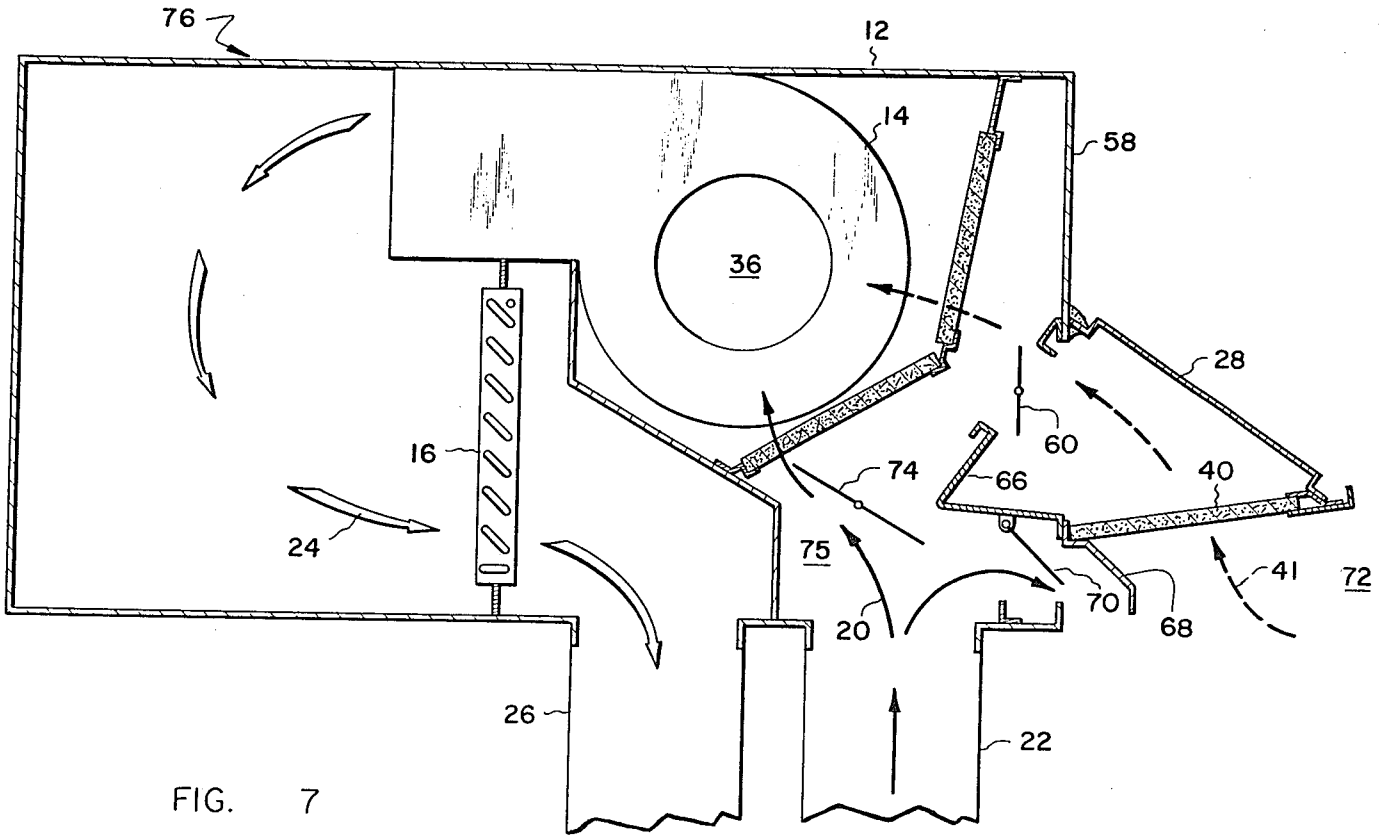
FIG. 7 is a schematic view of the air handling unit of FIG. 6.

Referring to FIGS. 6 and 7, airflow through a unit 76 is further regulated by means of a return air damper 74 and a relief valve 70. Return air damper 74 is disposed in a return air passage 75 and relief valve 70 is pivotally connected to the underside of baffle panel 66. Relief valve 70 vents return air 20 to atmosphere 72 in response to excess return air pressure within enclosure 76 relative to the barometric pressure of atmosphere 72. Relieving the return air pressure promotes the inflow of fresh air 41 through demisting filter 40 and into enclosure 76. With return air damper 74, relief valve 70, and power actuated damper 60, the proportion of fresh air 41 to return air 20 circulated through unit 76 is more effectively controlled.

Although the invention is described with respect to a preferred embodiment, modifications thereto will be apparent to those skilled in the art. Therefore, the scope of the invention is not limited by the preceding disclosure and is to be determined by reference to the claims which follow.

I claim:

1. An air handling enclosure comprising a fan disposed inside said enclosure and a cover panel selectively mountable in at least two positions, where in one position, a top edge of said cover panel is held against a generally vertical side wall of said enclosure, and a lower edge of said cover panel extends outwardly away from said enclosure to engage and add-on air handling device and uncover an enclosure opening that is in fluid communication with an inlet of said fan by way of a fresh air pasaage, and in an other position, said panel is in a generally vertical position with its top and lower edges held against said side wall to cover said opening with said add-on air handling device being separate from both said enclosure and said cover panel.

2. The enclosure of claim 1, further comprising a flow regulating damper disposed in said passage for regulating airflow through said opening.

3. The enclosure of claim 3, wherein the inlet of said fan is also in fluid communication with a return air passage having a return air damper disposed therein.

4. The enclosure of claim 1, wherein said add-on air handling device comprises a demisting filter that removes moisture from air passing therethrough.

5. The enclosure of claim 1, wherein said add-on air handling device comprises a generally triangular support panel.

6. The enclosure of claim 1, wherein said cover panel in said one position engages two generally triangular support panels and also extends over and engages a demisting filter.

7. The enclosure of claim 6, wherein said cover panel in said one position includes a rain gutter that directs water away from said demisting filter.

8. An air handling equipment enclosure comprising:

(a) a fan disposed inside said enclosure and having a fan inlet in fluid communication with a return air duct and connected to discharge air through a supply air duct;

(b) an air filter disposed inside said enclosure in series flow relationship with said fan;

(c) a heat exchanger disposed inside said enclosure in series flow relationship with said fan and said filters;

(d) a generally vertical side wall having an opering therethrough in fluid communication with said fan inlet; and (e) a generally rectangular cover panel that is selectively mountable in at least two positions, where in one position said cover panel uncovers said opening and engages a demisting filter and two generally triangular support panels such that an upper edge of said cover panel is held against said side wall and a lower edge of said cover panel extends outwardly away from said side wall to extend over and engage said filter with two other edges of said cover panel engaging said support panels, and in an other position said cover panel covers said opening and is in a generally vertical position with said edges of said cover panel held against said side wall with said filter and said support panels being separate from both said side wall and said cover panel.

9. The enclosure of claim 8, further comprising a damper connected to said enclosure in fluid communication with said opening and said inlet of said fan when said cover panel is in said one position, and in said other position, said damper is disconnected from said enclosure.

10. The enclosure of claim 8, wherein said inlet of said fan is also in fluid communication with a return air passage having a return air damper disposed therein.

11. The enclosure of claim 8, wherein said cover panel in said one position includes a rain gutter that directs water away from said demisting filter.

* * * * *

UNITED STATES PATENT AND TRADEMARK OFFICE

CERTIFICATE OF CORRECTION

PATENT NO. : 4,759,196

DATED : July 26, 1988

INVENTOR(S) : James Allen Davis

It is certified that error appears in the above-identified patent and that said Letters Patent is hereby corrected as shown below:

In the Claims:

Claim 1, Column 4, Line 3 "and" should be --an--.

Claim 3, Column 4, Line 14 "Claim 3" should be --Claim 2--.

Signed and Sealed this

Twenty-ninth Day of November, 1988

*Attest:*

DONALD J. QUIGG

*Attesting Officer*

*Commissioner of Patents and Trademarks*